United States Patent [19]

Crouch et al.

[11] 4,039,792

[45] Aug. 2, 1977

[54] COMPACT HIGH-CURRENT VACUUM CIRCUIT INTERRUPTER COMPRISING A METAL HOUSING THAT IS ELECTRICALLY CONNECTED TO ONE CONTACT OF THE INTERRUPTER

[75] Inventors: Donald Wayne Crouch, Newtown Square; Donald Reah Kurtz, West Chester; Joseph Carl Sofianek, Broomall, all of Pa.

[73] Assignee: General Electric Company, Philadelphia, Pa.

[21] Appl. No.: 642,222

[22] Filed: Dec. 19, 1975

[51] Int. Cl.[2] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 2,027,836 | 1/1936 | Rankin et al. | 200/144 B |
| 2,090,519 | 8/1937 | Rankin | 200/144 B |
| 3,082,307 | 3/1963 | Greenwood et al. | 200/144 B |
| 3,508,021 | 4/1970 | Bellis | 200/144 B |
| 3,590,185 | 6/1971 | Pflanz | 200/144 B |
| 3,612,795 | 10/1971 | Emmerich | 200/144 B |

FOREIGN PATENT DOCUMENTS

| | | | |
|---|---|---|---|
| 1,167,334 | 10/1969 | United Kingdom | 200/144 B |

*Primary Examiner*—Robert S. Macon

*Attorney, Agent, or Firm*—William Freedman

[57] ABSTRACT

A vacuum interrupter having a current interrupting rating exceeding 20,000 amperes r.m.s. comprises an evacuated envelope and first and second disc-shaped contacts within the envelope. The envelope comprises a metal housing having a generally cylindrical portion surrounding said contacts and electrically connected to said first contact. The space between said cylindrical portion and said second contact is so small that during the interruption of currents above 20,000 amperes r.m.s., 25% or more of the arcing current frequently will flow between said housing and said second contact and bypass said first contact. Arc-revolving means associated with the second contact causes any arc between the outer periphery of the second contact and the cylindrical housing portion to revolve about the second contact.

An electric bus located near the envelope is normally electrically connected to said first contact to carry current that flows between the contacts. Means located outside the evacuated envelope provides an electrical connection between the bus and the metal housing that is capable during interruption of carrying without damage the full rated interrupting current of the interrupter. The first contact is a movable contact mounted on a contact rod that is sealed to the housing by a flexible metal bellows located within the housing.

8 Claims, 3 Drawing Figures

27
25
14
35
23
62
10
21
18
63
12
L
30
34
3
3
32
73
16
64
40
41
2
46
20
47
48
49
38
45
2
50
50

COMPACT HIGH-CURRENT VACUUM CIRCUIT INTERRUPTER COMPRISING A METAL HOUSING THAT IS ELECTRICALLY CONNECTED TO ONE CONTACT OF THE INTERRUPTER

BACKGROUND

This invention relates to a vacuum circuit interrupter and, more particularly, to a vacuum circuit interrupter of the type in which the contacts of the interrupter are located within a metal housing that serves as a portion of the evacuated envelope of the interrupter and is electrically connected to one contact of the interrupter.

We are especially concerned with a vacuum interrupter of this type which is rated for interrupting currents greater than 20,000 amperes (r.m.s. interrupting current with any factor of asymmetry up to a maximum of 1.3). Such currents are typically interrupted by separating a pair of disc-shaped contacts to draw an arc therebetween through which arcing current flows until interruption is completed. It is usually assumed that substantially all the arcing current flows between the contacts. But when high currents in the above 20,000 ampere range are interrupted in the type of vacuum interrupter that comprises disc-shaped contacts and a metal housing connected to one contact and closely surrounding the contacts, this is definitely not the case. More particularly, we have found that frequently 25% or more of the arcing current in such an interrupter will flow between one of the contacts and the surrounding metal housing during interruption of these high currents.

This relatively high arcing current between one contact and the metal housing can cause damage to the interrupter unless special protective measures are taken.

SUMMARY

An object of our invention is to construct a highcurrent vacuum interrupter of the above-described metal-housing type in such a way that it can repeatedly interrupt without damage currents in the above-20,000 ampere range even if more than 25% of the arcing current during such interruptions follows a path through the metal housing bypassing one of the contacts.

While it is possible to essentially prevent flow of arcing current to the metal housing by providing a large amount of clearance between the housing and the contacts, this approach has the disadvantage of dictating relatively large dimensions for the interrupter.

Another object of our invention is to provide a high current interrupter of the above-described type comprising a metal housing connected to one contact which interrupter is exceptionally compact in both diameter and length.

In carrying out the invention in one form, we provide a vacuum interrupter rated to interrupt currents greater than 20,000 amperes r.m.s. The interrupter comprises an evacuated envelope and first and second disc-shaped contacts within the envelope. The envelope comprises a metal housing having a generally cylindrical portion surrounding said contacts and electrically connected to said first contact. The first contact is a movable contact mounted on a contact rod that is sealed to the housing by a flexible metal bellows located within the housing. The space between said cylindrical metal housing portion and said second contact is so small that during the interruption of currents above 20,000 amperes r.m.s., 25% or more of the arcing current frequently will flow between the housing and said second contact and bypass said first contact. Arc-revolving means associated with said second contact causes any arc between the outer periphery of the second contact and the adjacent cylindrical housing portion to revolve about the second contact, thus reducing arc-erosion of said cylindrical housing portion.

Adjacent the envelope there is an electric bus that is normally connected to said first contact to carry current that flows between the two contacts. Means located outside the envelope provides an electrical connection between the bus and the metal housing that is capable during interruption of carrying without damage at least half the rated interrupting current of the interrupter. This connection provides a low-impedance bypass around the bellows for arcing current between the metal housing and the second contact.

BRIEF DESCRIPTION OF DRAWINGS

For a better understanding of the invention, reference may be had to the accompanying drawings, wherein.

DETAILED DESCRIPTION OF PREFERRED EMBODIMENT

Figure 1:
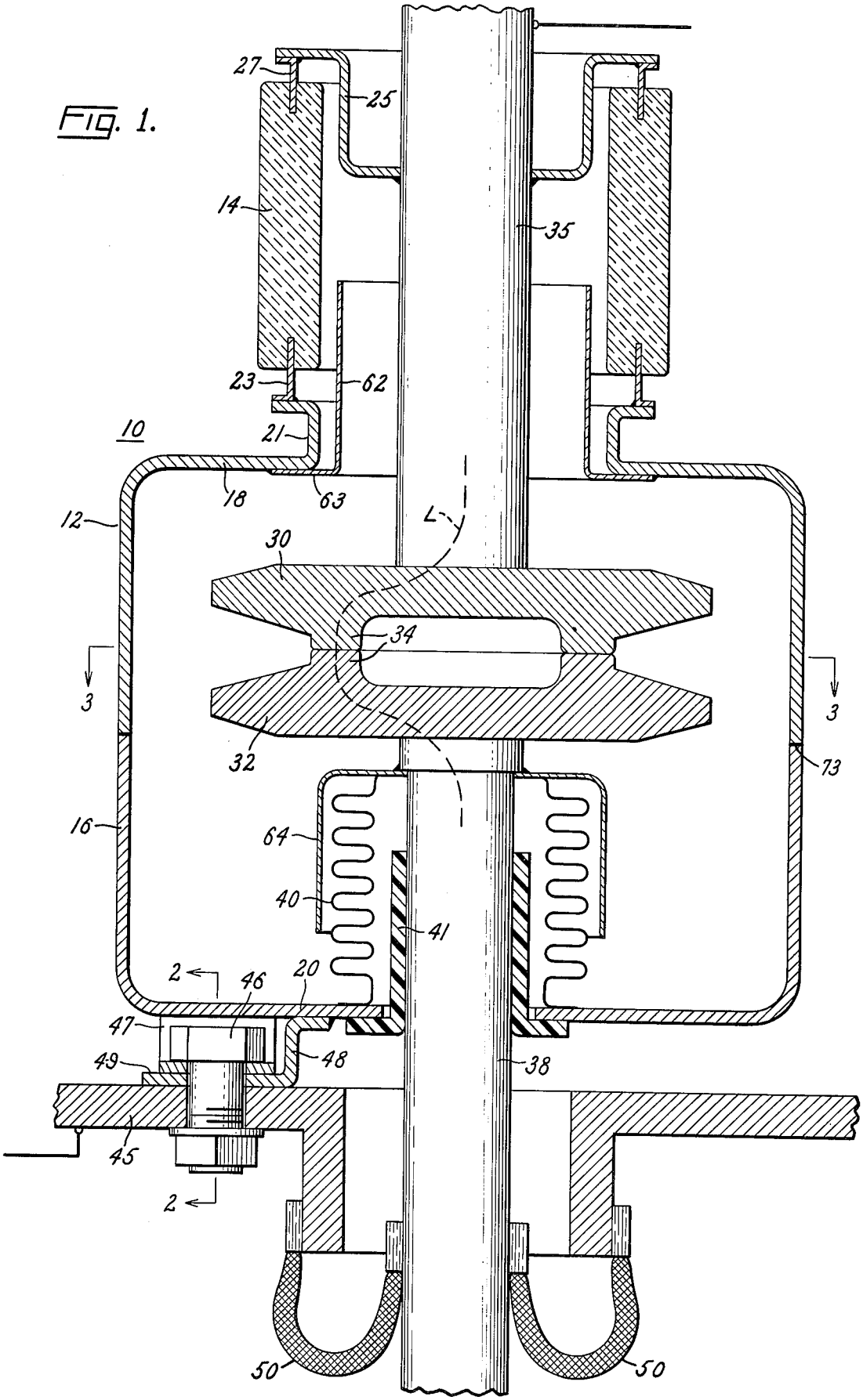
FIG. 1 is a side elevational view mostly in section showing a vacuum interrupter embodying one form of our invention.

Referring now to FIG. 1, the illustrated vacuum interrupter comprises a highly evacuated envelope 10 having a normal interior pressure of $10^{-4}$ torr or lower. This envelope 10 comprises a metal housing 12 and a tubular insulator 14, preferably of glass, at one end of the metal housing. The metal housing comprises a generally cylindrical portion 16 and a pair of integrally-formed end flanges 18 and 20 at its opposite ends extending radially inward from the cylindrical portion. In a preferred embodiment, the metal housing 12 is of stainless steel.

The upper end flange 18 has a portion 21 of U-shape cross-section at its radially-inner end, and this portion 21 is suitably joined in vacuum-tight relationship to a tubular end fitting 23 in the lower end of insulator 14. At the upper end of insulator 14 there is an inwardly-dished metal end cap 25 that is brazed to a tubular end fitting 27 in the upper end of insulator 14. The two end fittings 23 and 27 are embedded in the glass insulator 14 to provide conventional glass-to-metal seals.

Within the metal housing 12 there are two relatively movable disc-shaped contacts 30 and 32, each having a centrally-located annular arc-initiating portion 34. When the interrupter is in its closed position of FIG. 1, these contacts engage each other along their annular arc-initiating portions 34. Upper contact 30 is a generally stationary contact mounted on a generally stationary conductive contact rod 35, which is fixed to contact 30 generally centrally thereof. Lower contact 32 is a movable contact mounted on an axially-movable conductive contact rod 38, which is fixed to contact 32 generally centrally thereof. When the interrupter is closed, current flows through the contacts via a path such as that depicted at L.

Stationary contact rod 35 extends through insulator 14 in radially-spaced coaxial relationship thereto. The upper end cap 25 has a central opening through which stationary contact rod 35 extends, and a suitable brazed joint provides a vacuum-tight connection between end cap 25 and contact rod 35.

The movable contact rod 38 extends freely through a central opening in the lower end flange 20 of metal housing 12. A flexible metallic bellows 40 provides a vacuum-tight seal between the end flange 20 and contact rod 38 that allows contact rod 38 to be moved axially through an opening or closing stroke of the interrupter without impairing the vacuum within envelope 10. This bellows 40 is located within the cylindrical portion 16 of metal housing 12 and has its lower end joined to flange 20 and its upper end joined to contact rod 38. A suitable sleeve bearing 41 mounted on the end flange 20 exteriorly of the envelope 10 fits within bellows 40 to guide the movable contact rod 38 for substantially straight-line motion during its opening and closing strokes.

Figure 2:
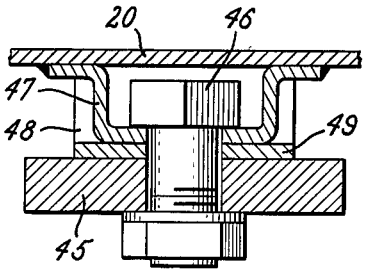
FIG. 2 is a sectional view along the line 2—2 of FIG. 1.

The envelope 10 is fixed to a conductive bus 45, preferably of copper, located adjacent its lower end. In the illustrated embodiment, this mechanical connection is effected through a series of U-shaped brackets 47, the legs of which are brazed to the lower end flange 20, as shown in FIG. 2. A plurality of such brackets (only one of which is shown) are located in circumferentially-spaced positions about the end flange 20. Each of these brackets is bolted to the bus 45 by suitable bolts 47 clamping the bracket to the bus. To provide a high conductivity electrical connection between the end flange 20 and the bus 45, a tab 48 of a high conductivity metal such as copper is brazed to the end flange 20 and has an extension 49 that is clamped between the bottom of bracket 47 and the top of copper bus 45. A high-pressure copper-to-copper joint is thus present between tab 48 and bus 45. A corresponding tab 48 is provided for each of the U-shaped brackets 47. The importance of a good electrical connection between the end flange 20 and bus 45 is explained in more detail hereinafter.

Bus 45 is also electrically connected to the movable contact rod 38. In the illustrated embodiment, this connection is effected by means of a plurality of flexible metal braids 50, each having one end connected to bus 45 and its other end connected to contact rod 38. When the circuit interrupter is in its normal closed position of FIG. 1, current flows therethrough via the braids 50, following a path that extends through bus 45, braids 50, and parts 38, 32, 30, and 35 in series.

Figure 3:
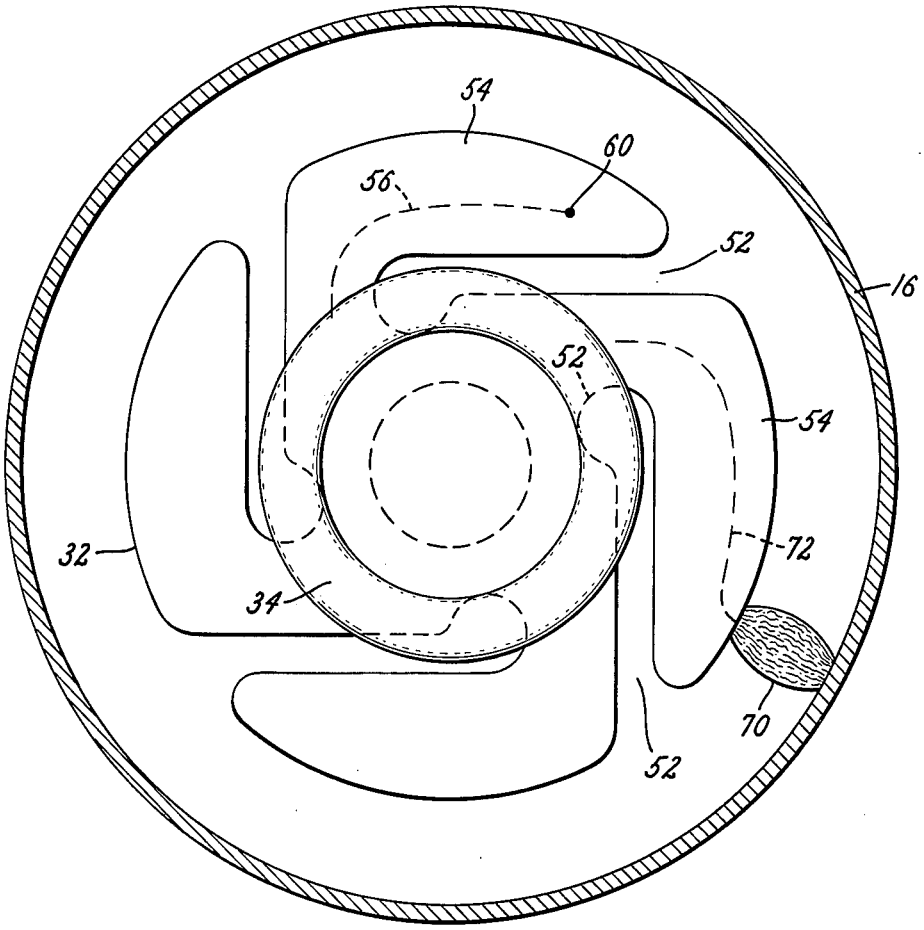
FIG. 3 is a sectional view along the line 3—3 of FIG. 1.

Circuit interruption is initiated by driving the contact rod 38 in a downward direction to separate contacts 30 and 32. This initiates an arc between the annular arc-initiating portions 34 of the contacts. This arc is driven in a radially outward direction by the magnetic effect of current flowing through the loop-shaped path L through the contacts. As the arc moves radially outward, it is caused to revolve circumferentially of the contacts. This arc-revolving effect is produced by a series of circumferentially-spaced slots 52 in each contact dividing the contact into a plurality of circumferentially-spaced fingers 54, as best shown in FIG. 3. These slots correspond to similarly shaped slots in U.S. Pat. No. 3,809,836-Crouch, assigned to the assignee of the present invention, and references may be had thereto for a more detailed description of the slots and their operation.

In general, these slots 52 force the current flowing to or from an arc terminal on a finger 54 to follow a path through the finger that extends circumferentially of the disc in the vicinity of the arc. For example, if the arc terminal is at a position 60 in FIG. 3, the effective path of the current flowing through the finger 54 to the arc will be as shown at 56, extending circumferentially of the disc. This circumferential component of this current path causes the current flowing through the loop L to develop a net circumferentially-acting force component which revolves the arc about the central axis of the disc.

This circumferentially-acting force component is high enough to drive each terminal of the arc across the slots 52 at the free end of fingers 54, thus producing a continuous revolving motion of the arc on the contact surface.

For condensing the metal vapors generated by arcing, we rely primarily upon the metal housing 12 to act as a vapor-condensing shield. Most of the metal vapors generated by arcing between the contacts are expelled radially outward from the inter-contact gap and are intercepted and condensed by the cylindrical portion 16 of the metal housing. A minor percentage of the metal arcing products are discharged axially of the contacts, and most of these are condensed either on the end flanges 18 and 20 of the metal housing 12 or on auxiliary shields 62 and 64.

Auxiliary shield 62 is a tubular metal member surrounding the stationary contact rod 35 in radially-spaced relationship and, in turn, surrounded in radially-spaced relationship by tubular insulator 14. A radially-extending flange 63 on the inner end of auxiliary shield 62 is brazed to metal housing 12 to support the auxiliary shield. This auxiliary shield 62 serves to intercept and condense metal vapors discharging through the space around stationary contact rod 35 before such vapors can reach the insulator 14 and condense thereon.

The other auxiliary shield 64 is an inverted cup-shape metal member that surrounds the bellows 40 and serves primarily to protect the bellows from the arcing products.

For the sake of compactness and economy, it is desirable that the cylindrical portion 16 of metal housing 12 have as small a diameter as possible. At the same time, it is necessary for the contacts 30 and 32 to have a certain minimum diameter if they are to interrupt currents of a given magnitude. Fulfilling these two requirements results in an interrupter in which only a relatively small clearance space is present between the outer periphery of the contacts and the inner periphery of the cylindrical portion 16 of the metal housing 12. By way of example and not limitation, in an interrupter having a voltage rating of 4.16 kV and rated to interrupt 25,000 to 30,000 amperes with any degree of asymmetry up to 1.3, we utilize a contact 30 having a diameter of $4\frac{1}{4}$ inches and a metal housing having an inside diameter of about $5\frac{5}{8}$ inches, with a resultant clearance of only about 11/16 inch between the outer periphery of contact 30 and the inner periphery of the metal housing.

It is usually assumed that when a vacuum interrupter interrupts a circuit, substantially all the arcing current flows between the contacts. But this is definitely not the case when high currents in the above-20,000 ampere range are interrupted in the disclosed type of interrupter (i.e., one comprising a metal housing closely surrounding the contacts and connected to one contact). More particularly, we have found that frequently 25% or more of the arcing current in such an interrupter will flow between contact 30 and metal housing 12 during interruption of these high currents. In one test run in which 20,000 amperes r.m.s. was interrupted, about 50% of the arcing current was between contact 30 and metal housing 12.

To enable such currents through the housing to be handled without damage to the interrupter, a number of special protective measures are taken. First, the electrical connection between the bus 45 and the metal housing 12 is provided with sufficient effective area and conductivity that it can carry during interruption at least one half and preferably the full rated interrupting current without damage. In this respect, three circumferentially-spaced copper tabs 48, each brazed over a broad area to the lower end flange and firmly clamped against the bus 45 by bolts 48, are provided so as to make available high-conductivity, high-pressure electrical connections between the end flange and the bus. Another reason why it is important for these connections between flange 20 and bus 45 to have a very low impedance is that these connections are electrically in parallel with the metallic bellows 40 in the path between the flange 20 and bus 45, and it is essential that the current through this bellows be limited to a very low level to protect it against the heating and welding effects of such current.

Another protective measure is the arc-revolving ability that is incorporated in the stationary contact structure 30. This arc-revolving ability is present whether the arc extends axially of the interrupter between the spaced contacts 30 and 32 or extends radially of the interrupter between contact 30 and the surrounding cylindrical portion 16 of metal housing 12. Such a radially-extending arc is depicted at 70 in FIG. 3. It can be seen in FIG. 3 that the current path 72 through the slotted contact 32 via a finger 54 to the terminal of such an arc (70) has a circumferentially-extending component, and current through a path of this configuration will develop a circumferentially-acting force on the radially-extending arc which drives it circumferentially of the disc-shaped contact. Driving the radially-extending arc circumferentially of the contact 30 denies the arc a stationary footing on the metal housing 12, thus protecting the housing against damage from the erosive effects of the arc. Unless the high current arc is kept moving while its terminal is on housing 12, it can melt through the thin wall of the housing.

Although the discharge between the housing and the contact has depicted as a single arc of rather restricted cross section, this may not always be the case. There are indications that the discharge is sometimes much more diffuse than that depicted.

While it is possible to essentially prevent the flow of arcing current to the housing 12 by increasing the diameter of the housing so as to increase the radial clearance between contact 30 and the housing, this will detract from the desired compactness of the interrupter and has therefore been avoided.

An additional feature of our interrupter contributing to its desired compactness is the location of the bellows 40 inside the cylindrical portion 16 of the metal housing 12. Had the bellows been located instead within the insulator 14, an insulator of considerably larger diameter than that shown would have been required to accommodate the bellows and its surrounding shield 64. Also, it would have been necessary to increase the length of the insulator to accommodate any bellows located therein in order to provide ample electrical clearance between the bellows shield and the auxiliary shield 62. While the bellows does consume some length dimension in the metal housing 12, this length serves the important role of making available a large-volume region of substantially no electrical stress in which the arcing products developed within the housing 12 during high-current interruptions can expand to promote circuit interruption.

As pointed out hereinabove, the metal housing 12 in the preferred illustrated embodiment is of stainless steel. There are several distinct advantages of using this particular metal of the housing. First, a stainless steel housing (or its components) can be baked at a high temperature to clean it and remove gases therefrom prior to its incorporation in the interrupter without significantly impairing its mechanical strength. Such high temperature baking would mechanically weaken a housing of copper. Secondly, stainless steel is more resistant to arc erosion than lower melting-point metals such as copper and thus can withstand more arcing between the housing and contact 30 without melting through. Also, the much higher resistivity of stainless steel compared to copper and the somewhat higher arc voltage developed by stainless steel at a given current compared to copper tend advantageously to reduce the arcing current through the housing during high current interruptions.

Preferably, the housing 12 is made in two parts joined together along a circumferential butt-welded seam 73. In a preferred form of the invention, this seam is axially displaced from the inter-contact gap and from stationary contact 30. The seam 73 is preferably made by a tungsten-electrode inert-gas welding process, and there is a possibility of some very slight oxidation at the weld. By displacing the seam from the region of most intense arcing, there is less chance that any oxides present will be decomposed into oxygen by such arching, which could detract from high-current interrupting ability.

In a preferred form of the invention, the contacts 30 and 32 are primarily of copper. The gap between the contacts when they are fully separated is about ½ inch. If the gap was much smaller than this, there would be less arcing current to the metal housing 12, assuming the same contact-to-housing clearance; but an inter-contact gap of approximately this value is needed to assure prompt interruption by rapidly forcing the arc radially outward off the arc-initiating portions 34 onto the slotted arc-revolving portions of the contact at 54.

While we have shown and described a particular embodiment of our invention, it will be obvious to those skilled in the art that various changes and modifications may be made without departing from our invention in its broader aspects; and we, therefore, intend in the appended claims to cover all such changes and modifications as fall within the true spirit and scope of our invention.

What we claim as new and desire to secure by Letters Patent of the United States is:

1. A vacuum circuit interrupter having a current interrupting rating exceeding 20,000 amperes r.m.s. with any factor of asymmetry up to 1.3, comprising:

a. a pair of disc-shaped contacts relatively movable into and out of engagement with each other, with circuit interruption being effected by moving said contacts out of engagement with each other to establish a gap therebetween, b. a movable conductive contact rod fixed to a first one of said contacts generally centrally of said first contact, c. a generally stationary contact rod fixed to a second one of said contacts generally centrally of said second contact, d. a highly evacuated envelope comprising:

$d_1$. a metal housing electrically connected to said first contact and having a generally cylindrical metal portion surrounding said contacts and a pair of generally radially-extending metal end flanges at opposite ends of said cylindrical portion, and $d_2$. a tubular insulator fixed to one of said end flanges and surrounding said stationary contact rod in radially-spaced relationship, the space between the cylindrical portion of said metal housing and said second contact beins so small that during the interruption of rated currents above 20,000 amperes r.m.s., 25% or more of the arcing current frequently will flow between said housing and said second contact and bypass said first contact, e. a flexible metal bellows located for the most part within said metal housing, providing a seal between the other of said end flanges and said movable contact rod, and allowing axial movement of said movable contact rod with respect to said metal housing, f. means located at the outer end of said insulator for supporting said stationary contact rod on said insulator, g. an electric bus located adjacent said other end flange, h. means located outside said evacuated envelope for providing an electrical connection between said bus and said other end flange that is capable during interruption of carrying without damage at least one-half of the rated interrupting current of said interrupter, through which connection arcing current between said metal housing and said second contact flows, said connection forming a bypass around said bellows for said arcing current between the metal housing and said second contact, the impedance of said bypass being sufficiently low to limit any arcing current through said bellows to a value low enough to prevent damage to said bellows by said arcing current, i. means providing an electrical connection between said bus and said movable contact rod through which current between said contacts flows via a path extending through rod movable contact rod, j. and arc-revolving means associated with said second contact for causing any arc developed between the outer periphery of said second contact and said cylindrical metal housing portion to revolve about said second contact.

2. The vacuum interrupter of claim 1 in which said metal housing is primarily of stainless steel.

3. The vacuum interrupter of claim 1 in which said metal housing is primarily of stainless steel and comprises two generally cylindrical sections welded together along a circumferential seam, said seam being axially displaced from said first contact and from the gap between the contacts.

4. The vacuum interrupter of claim 1 in which said contacts are primarily of copper and said metal housing is primarily of stainless steel.

5. The vacuum interrupter of claim 1 in which:

a. the gap between said contacts when the interrupter is fully open has a length of about ½ inch, and b. the clearance between the outer periphery of said second contact and the cylindrical portion of said metal housing is slightly larger than said gap length and no greater than 1½ inches.

6. The vacuum interrupter of claim 1 in which said electrical connection of (*h*) is capable of carrying during interruption the full rated interrupting current of the interrupter without damage.

7. The vacuum interrupter of claim 1 in which said arc-revolving means comprises a plurality of circumferentially-spaced slots in said second disc-shaped contact, each extending from the outer peripheral region to the central region of said second contact.

8. The vacuum interrupter of claim 1 in which most of the arcing current during interruption flows across the gap between said two contacts, passing through the interrupter without entering the walls of said metal housing.

* * * * *